United States Patent [19]

Lau et al.

[11] Patent Number: 4,552,834

[45] Date of Patent: Nov. 12, 1985

[54] ENHANCED BLEACHING OF PHOTOGRAPHIC ELEMENTS CONTAINING SILVER HALIDE AND ADSORBED DYE

[75] Inventors: Philip T. S. Lau; Gary M. Einhaus, both of Rochester, N.Y.

[73] Assignee: Eastman Kodak Company, Rochester, N.Y.

[21] Appl. No.: 717,256

[22] Filed: Mar. 28, 1985

Related U.S. Application Data

[63] Continuation-in-part of Ser. No. 638,005, Aug. 6, 1984, abandoned.

[51] Int. Cl.[4] ..... G03C 7/00; G03C 5/44; G03C 5/42

[52] U.S. Cl. ..... 430/393; 430/430; 430/461; 430/543; 430/564

[58] Field of Search ..... 430/528, 460, 461, 393, 430/564, 430, 543

[56] References Cited

U.S. PATENT DOCUMENTS

| | | | |
|---|---|---|---|
| 3,615,508 | 10/1971 | Stephen et al. | 430/393 |
| 3,671,255 | 6/1972 | Haga | 430/607 |
| 3,748,136 | 7/1973 | Willems | 430/430 |
| 3,770,437 | 11/1973 | Brugger et al. | 430/379 |
| 3,827,886 | 8/1974 | Ishihra et al. | 430/489 |
| 3,870,520 | 3/1975 | Shimamura et al. | 430/393 |
| 4,013,470 | 3/1977 | Landon | 430/564 |
| 4,186,008 | 1/1980 | Schar et al. | 430/393 |
| 4,242,442 | 12/1980 | Idota et al. | 430/393 |
| 4,268,618 | 5/1981 | Hashimura | 430/393 |

OTHER PUBLICATIONS

Research Disclosure, vol. 228, Apr. 1983, Item 22843, "Retouching Bleaches for Photographic Prints Prepared by the Dye Transfer Process".

Research Disclosure, vol. 225, Jan. 1983, Item 22543, "Sensitized High Aspect Ratio Silver Halide Emulsions and Photographic Elements".

*Primary Examiner*—Mary F. Downey

*Attorney, Agent, or Firm*—Carl O. Thomas

[57] ABSTRACT

The bleaching from photographic elements of silver produced by the development of silver halide having a dye adsorbed to its surface by employing as a bleaching agent a ferric complex of a polycarboxylic acid is improved by the presence of a compound of the formula:

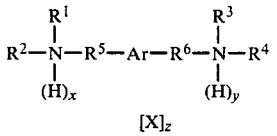

(I)

wherein

Ar is an aromatic linking group, $R^1$, $R^2$, $R^3$, and $R^4$ are hydroxy substituted lower alkyl groups, $R^5$ and $R^6$ are lower alkanediyl groups, X is a charge balancing counter ion, x and y are 0 or 1, and z is 0, 1, or 2.

32 Claims, No Drawings

ENHANCED BLEACHING OF PHOTOGRAPHIC ELEMENTS CONTAINING SILVER HALIDE AND ADSORBED DYE

This is a continuation-in-part of U.S. Ser. No. 638,005, filed Aug. 6, 1984 now abandoned.

FIELD OF THE INVENTION

This invention relates to the bleaching of silver from photographic elements, to radiation sensitive photographic elements containing dye adsorbed to silver halide surfaces, and to bleaching solutions containing a ferric complex of a polycarboxylic acid.

BACKGROUND OF THE INVENTION

*Research Disclosure,* Vol 228, April 1983, Item 22843, discloses overall bleaches for reducing the density of dye image prints produced by transferring dye from separation positives. Three specifically identified overall bleaching agents are 1,4-phenylenedimethylbis(2,2'-iminodiethanol) dihydrochloride, N-benzyl-N-tri(2-hydroxyethyl) ammonium chloride, and 1,4-phenylene bis[methyltri(2-hydroxyethyl)ammonium chloride]. *Research Disclosure* is a publication of Kenneth Mason Publications Limited; Emsworth; Hampshire P010 7DD; United Kingdom.

The use of ferric complexes of polycarboxylic acids to bleach silver from processed silver halide photographic elements is well known in the art. The use of such complexes, optionally with concurrent fixing of silver halide, is illustrated by U.S. Pat. Nos. 3,615,508, 3,770,437, 3,870,520, 4,242,442, and 4,288,618. These patents teach that ferric complexes of polycarboxylic acids are recognized to be environmentally preferable to ferric cyanide bleaches, but suffer from a limited oxidation capability, which is manifested by limited bleaching capacity and in some instances by leaving imaging dyes in a less than fully oxidized leuco form.

*Research Disclosure,* Vol. 225, January 1983, Item 22534 discloses spectrally sensitized high aspect ratio tabular grain emulsions to be advantageous in silver halide photographic elements. It is well known in the art that spectral sensitizing dyes are effective by reason of being adsorbed to silver halide surfaces and that a substantially optimum level of spectral sensitizing dye is a function of the available silver halide surface area. Generally spectral sensitizing dye concentrations are specified in terms of a percentage of a monomolecular dye layer coverage of the silver halide surface area available. Because of the high ratio of surface area to volume of high aspect ratio tabular grains, high ratios of spectral sensitizing dye to silver halide can be present.

PROBLEM ADDRESSED BY THE INVENTION

In bleaching with a ferric complex of a polycarboxylic acid silver produced by development of photographic elements containing spectrally sensitized high aspect ratio tabular grain silver halide emulsions, higher than anticipated residual silver levels have been encountered. This has resulted in the recognition new to the art that dye adsorbed to silver halide surfaces inhibits ferric complexes of polycarboxylic acids in the bleaching of silver produced by development of the silver halide.

SUMMARY OF THE INVENTION

It is the recognition of this invention that adsorbed dye inhibition of the bleaching of silver from silver halide photographic elements when ferric complexes of polycarboxylic acids are employed as bleaching agents can be counteracted by the presence during the bleaching step of a compound of the formula:

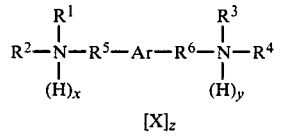

(I)

wherein

Ar is an aromatic linking group, $R^1$, $R^2$, $R^4$, and $R^4$ are hydroxy substituted lower alkyl groups, $R^5$ and $R^6$ are lower alkanediyl groups, X is a charge balancing counter ion, x and y are 0 or 1, and z is 0, 1, or 2.

In one aspect this invention is directed to a process of bleaching from a photographic element silver produced by development of silver halide having dye adsorbed to its surface comprising employing a ferric complex of a polycarboxylic acid as a bleaching agent. The improvement comprises bleaching in the presence of a bleach enhancing amount of the compound of formula (I).

In another aspect this invention is directed to a photographic element containing a dye adsorbed to radiation sensitive silver halide, characterized by the improvement comprising a bleach enhancing amount of the compound of formula (I).

In another aspect this invention is directed to a bleaching solution containing a ferric complex of a polycarboxylic acid as a bleaching agent and a bleach enhancing amount of the compound of formula (I).

By employing a compound of formula (I) reductions in residual silver levels—that is, silver levels still present following bleaching—can be achieved. With reduced residual silver, contrast is decreased and image quality and color saturation are improved. Additionally the infrared density of the photographic element contributed by the residual silver can be reduced, which is advantageous when sound track or other infrared absorbing features, such as control markings, form a part of the photographic element. As an alternative to lowering residual silver levels an advantage can be realized in acceleration of the bleaching step, if desired. While the advantages of the present invention can be generally realized with photographic elements which contain dye adsorbed to developable silver halide surfaces, they are particularly pronounced with photographic elements containing spectrally sensitized high aspect ratio tabular grain emulsions.

DESCRIPTION OF PREFERRED EMBODIMENTS

In formula (I) $R^1$, $R^2$, $R^3$, and $R^4$ can be independently selected from among hydroxy substituted lower alkyl groups. In a preferred form the hydroxy substituted lower alkyl groups can take the form of $—C_nH_{2n}OH$ groups, where n can take any value from 1 to 5. In specifically preferred forms the hydroxy substituted lower alkyl groups are hydroxymethyl, β-hydroxyethyl, or γ-hydroxypropyl groups.

In formula (I) $R^5$ and $R^6$ can be independently selected from among lower alkanediyl groups. Preferred alkanediyl groups are $—C_nH_{2n}$-groups, where n can take any value of from 1 to 5 carbon atoms. Specifically preferred alkanediyl groups are methanediyl and ethanediyl groups.

In formula (I) Ar can take the form of any convenient divalent aromatic linking group. The aromatic linking group can take the form of a single carbocyclic aromatic nucleus, such as a phenylene or naphthalene linking group. Generally equivalent performance may be realized with heterocyclic aromatic nuclei. Instead of employing a single aromatic nucleus the aromatic linking group can contain two are more terminal aromatic nuclei joined directly or through an intermediate linkage. By terminal aromatic nuclei it is meant that $R^5$ and $R^6$ are each bonded directly to an aromatic ring. A biphenylene group is a specifically preferred divalent carbocyclic aromatic linking group containing two directly joined terminal aromatic nuclei. Instead of being directly joined the terminal aromatic nuclei can be linked by any convenient intermediate divalent linking group, such as a divalent chalcogen (preferably oxygen or sulfur), a lower alkanediyl group (preferably as described above in connection with $R^5$ and $R^6$), a sulfo group, or a carbonyl group. The divalent aromatic linking group can be substituted, if desired. Substituents such as alkoxy, halo, alkyl, hydroxy, —COOM and —$SO_3M$ (where M is chosen to complete an acid, salt, or ester moiety), sulfonamido, or sulfamoyl substituents are specifically contemplated. Polar substituents can be usefully employed to enhance water solubility, but are not necessary to achieve acceptable water solubility when preferred divalent aromatic linking groups are employed. Water solubility is also enhanced when one or both of the nitrogen atoms indicated in formula (I) bonded to $R^5$ and $R^6$ are protonated.

When the nitrogen atoms indicated in formula (I) are not protonated, it is apparent that x and y are zero. The counter ion X in formula (I) is present only when required to impart charge neutrality to the compound. Generally a negative counter ion is required when either x or y is 1 and the compound contains no charge imparting substituents beyond the nitrogen atoms. In this instance when x and y are both 1, z is 2. However, when either or both of x and y are 1, no counter ion may be required, since one or more other substituents, such as the —COOM or —$SO_3M$ substituents discussed above, can internally balance the ionic charge on the molecule. It is also possible for substituents such as —COOM or —$SO_3M$ to impart a net negative charge to the molecule, requiring X to take the form of a positive counter ion. Useful negative counter ions can be selected from among acid anions, such as a halide, nitrate, sulfonate, and carboxylate anions, while useful positive counter ions can be selected from among base cations, such as ammonium and alkali metal ions. Although useful in influencing water solubility, whether the nitrogen atoms of formula (I) form amines or protonated amines does not otherwise control their utility in the practice of this invention.

It is surprising that the compounds of formula (I) are useful while analogous aromatic amines, protonated amines, and ammonium salts containing a single nitrogen atom as well as analogous diamines, protonated diamines, and diammonium salts in which the nitrogen atoms are bonded directly to the aromatic linking group have been observed to be ineffective. Still further, it has been recognized that diammonium salts analogous to the diamines and protonated diamines herein employed are in some instances bleach inhibitors rather than bleach accelerators. This is more specifically illustrated in the Examples below.

The following is a listing of preferred compounds satisfying formula (I), indicated by I, and comparative compounds, indicated by C, the latter having been demonstrated to be inferior in performance, as shown in the Examples below:

TABLE 1

1,4-Phenylenedimethyl bis(2,2'-iminodiethanol)

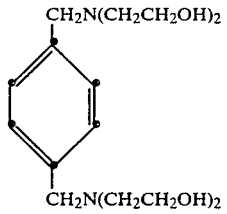

A-I 1,3-Phenylenedimethyl bis(2,2'-iminodiethanol) dihydrochloride B-I

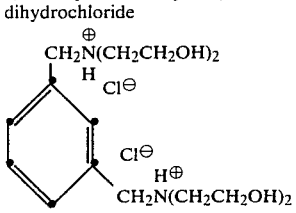

Benzyl-2,2'-iminodiethanol

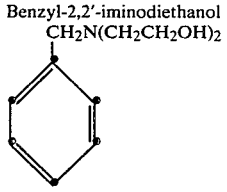

C-C Benzyl-2-iminoethanol D-C

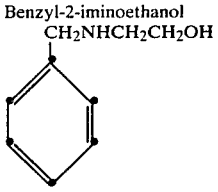

N,N—di(2-hydroxyethyl) aniline

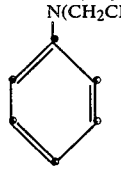

E-C Di(2-hydroxyethyl) amine F-C
$NH(CH_2CH_2OH)_2$

Tris(2-hydroxyethyl) amine

G-C N,N,N',N'—Tetra(2-hydroxyethyl) ethylenediamine H-C

-continued

TABLE 1

$HOCH_2CH_2N(CH_2CH_2OH)_2$

N,N,N',N'—Tetra(3-hydroxypropyl) ethylenediamine I-C $(HOCH_2CH_2CH_2)_2NCH_2CH_2N(CH_2CH_2CH_2OH)_2$ 2,4,6-Tris[di(2-hydroxyethyl)amino] triazine K-C

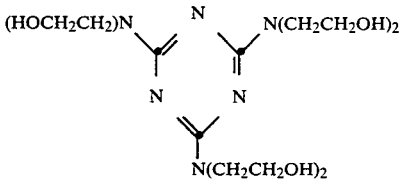

1,4'-Biphenylene dimethylbis(2,2'-iminodiethanol) M-I

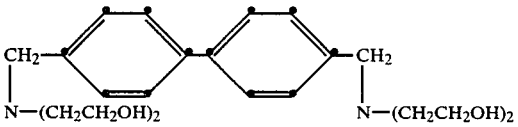

N—Benzyl-N—tri(2-hydroxyethyl)ammonium chloride O-C

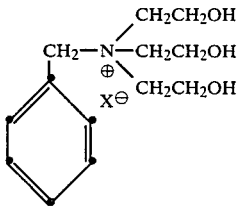

2-[N,N—di(2-hydroxyethyl)imino]acetic acid Q-C

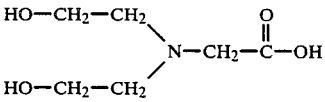

$(HOCH_2CH_2)_2N—CH_2CH_2N(CH_2CH_2OH)_2$ 2,4-Bis[di(2-hydroxyethyl)amino]-6-chloro triazine J-C

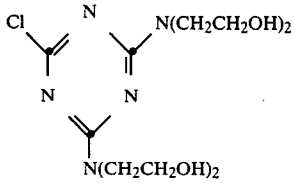

1,4-Phenylenedimethylbis(2,2'-iminodiethanol) dihydrochloride L-I

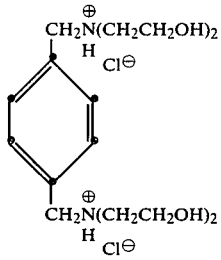

1,4-Phenylene bis[methyltri(2-hydroxyethyl) ammonium chloride] N-C

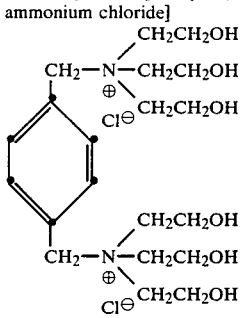

1,4-(2,5-Dibromo)phenylene dimethylbis-(2,2'-iminodiethanol) P-I

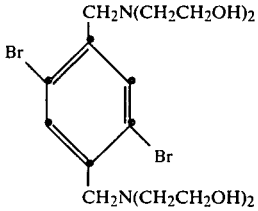

4-[Di(2-hydroxyethyl)aminomethyl]phenyl sulfonic acid, sodium salt R-C

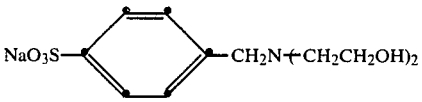

1,4'-Biphenylene bis[methyltri(2-hydroxyethyl) ammonium chloride] S-C

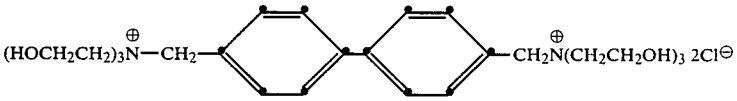

4,4'-Bis[N,N—di(2-hydroxyethyl)aminoethyl]di-phenyl ether dihydrochloride T-I

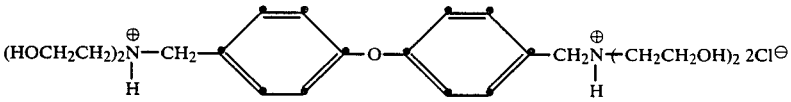

4,4'-Phenyleneoxyphenylenebis[methyltri(2-hydroxyethyl) ammonium chloride U-C

-continued
TABLE 1

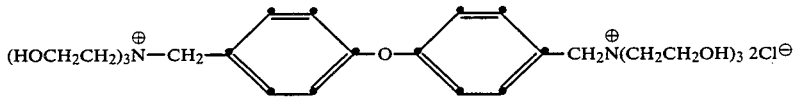

1,4'-Phenylenedimethyl bis(2,2'-iminoethanol) dihydrochloride V-I

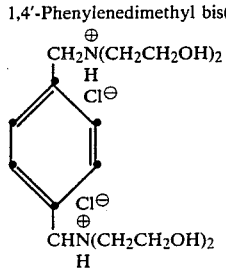

1,3-Phenylenedimethyl bis(2,2'-iminodiethanol) W-I

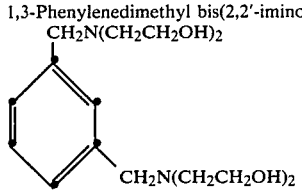

N,N,N',N'—Tetra(2-hydroxyethyl)-1,4-phenylene diamine X-C

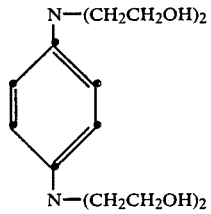

N,N,N',N'—Tetra(2-hydroxyethyl)-1,3-phenylene diamine Y-C

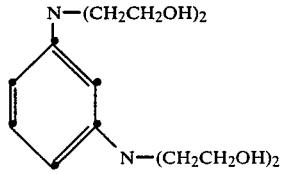

N,N'—Di(2-hydroxyethyl)piperazine Z-C

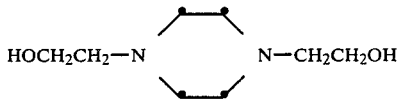

The compounds of the formula (I) are useful in reducing optical density levels of silver in photographic elements in which the silver is produced by developing silver halide which has a dye adsorbed to its surface. To provide a simple example, the silver image produced by imagewise exposure and development of a silver halide photographic element containing a dye adsorbed to the silver halide surfaces, such as an orthochromatically or panchromatically sensitized black-and-white photographic element, can be reduced in maximum density (e.g., erased) by bleaching with a ferric complex of a polycarboxylic acid in the presence of a compound according to formula (I). The formula (I) compound can be initially present in the photographic element, in the bleaching solution, or in both. The photographic element can be extremely simple, requiring only a support, radiation sensitive silver halide, and a dye adsorbed to the silver halide surface, such as the spectral sensitizing dye or dyes used for orthochromatic or panchromatic sensitization. Typically the silver halide is coated on the support in the form of an emulsion layer, although the invention is compatible with other arrangements, such as a vacuum vapor deposited layer of silver halide or silver halide confined to discrete sites on the support surface (e.g., confined to microareas, as illustrated by Whitmore U.S. Pat. No. 4,362,806, Blazey et al U.S. Pat. No. 4,307,165, and Gilmour et al U.S. Pat. No. 4,411,973).

The bleaching of silver is commonly undertaken in forming viewable dye images in silver halide photographic elements, and this constitutes one preferred application of the invention. For example, the black-and-white photographic element described above can be converted to a color photographic element merely by including in the element or during processing a dye image providing material which responds to the pattern of silver halide development to produce a dye image. In this instance silver is the unwanted by-product of producing the dye image and is removed by bleaching.

In its preferred application this invention is directed to bleaching silver from photographic elements capable of producing multicolor dye images. Such photographic elements are typically comprised of a support having coated thereon a plurality of color forming layer units. The color forming layer units include at least one blue recording yellow dye image forming layer unit, at least one green recording magenta dye image forming layer unit, and at least one red recording cyan dye image forming layer unit. Each color forming layer unit includes at least one silver halide emulsion layer. A dye image providing material can be located in the emulsion layer, in an adjacent layer, or introduced during development. The emulsion layer or layers in the blue recording layer unit can rely on native sensitivity to blue light or contain adsorbed to the silver halide grains of the emulsion a dye capable of absorbing blue light—a blue sensitizing dye. Spectral sensitizing dyes capable of absorbing green and red light are adsorbed to silver halide grain surfaces in the emulsions layers of the green and red recording color forming layer units, respectively.

To prevent color contamination of adjacent color forming layer units oxidized development product (including oxidized developing agent and oxidized electron transfer agent) scavengers can be incorporated at any location in the color forming layer units or an interlayer separating the adjacent color forming layer units.

Useful scavengers include alkyl substituted aminophenols and hydroquinones, as disclosed by Weissberger et al U.S. Pat. No. 2,336,327 and Yutzy et al U.S. Pat. No. 2,937,086, sulfoalkyl substituted hydroquinones, as illustrated by Thirtle et al U.S. Pat. No. 2,701,197, and sulfonamido substituted phenols, as illustrated by Erikson et al U.S. Pat. No. 4,205,987.

It is often desirable to employ a plurality of silver halide emulsion layers differing in speed to record each of blue, green, and red. Separate silver halide emulsion layers differing in speed can be located in a single color forming layer unit. Alternatively more than one color forming layer unit can be employed to record any or each of blue, green, and red. A preferred layer order arrangement in which single blue, green, and red color forming layer units are present and plural silver halide emulsion layers are present in each color forming layer unit locates the silver halide emulsion layer or layers of higher speed to receive exposing radiation first. A particularly preferred layer order arrangement employs two green and two red color forming layer units with one of each of the green and red color forming layer units containing a higher speed silver halide emulsion layer and being located to receive exposing radiation prior to the remaining green and red color forming layer units, which contain one or more lower speed silver halide emulsion layers. Such a preferred layer order arrangement is illustrated by Eeles et al U.S. Pat. No. 4,184,876 and in the Examples below. When high aspect ratio tabular grain silver halide emulsions are employed advantageous layer order arrangements of the type disclosed by *Research Disclosure* 22534, cited above, are specifically contemplated.

Any conventional silver halide emulsion containing a dye adsorbed to the surface of the silver halide grains can be employed. For color print applications silver chloride, silver bromide, and silver chlorobromide emulsions are particularly contemplated while for camera speed photography silver bromoiodide emulsions are preferred. The silver halide emulsions can be direct-positive emulsions, such as internal latent image desensitized emulsions, but are in most applications negative-working. Illustrative silver halide emulsion types and preparations are disclosed in *Research Disclosure,* Vol. 176, January 1978, Item 17643, Paragraph I.

Particularly preferred silver halide emulsions are high aspect ratio tabular grain emulsions, such as those described in *Research Disclosure,* Vol. 22534, cited above. Most specifically preferred for camera speed photographic elements are high aspect ratio tabular grain silver bromoiodide emulsions also described in Wilgus U.S. Pat. No. 4,434,226, Kofron et al U.S. Pat. No. 4,439,520, and Solberg et al U.S. Pat. No. 4,433,048, each here incorporated by reference. High aspect ratio tabular grain emulsions are those in which the tabular grains having a diameter of at least 0.6 μm and a thickness of less than 0.5 μm (preferably less than 0.3 μm) have an average aspect ratio of greater than 8:1 (preferably at least 12:1) and account for greater than 50 percent (preferably greater than 70 percent) of the total projected area of the silver halide grains present in the emulsion.

Illustrative dyes usefully adsorbed to silver halide grain surfaces are those dyes commonly employed to alter the native sensitivity, extend the spectral sensitivity, or to perform both functions in silver halide emulsions, often collectively referred to as spectral sensitizing dyes. Such dyes are most commonly employed to extend sensitivity to the minus blue (longer than 500 nm) portion of the spectrum. The dyes which absorb light in the blue portion of the spectrum can be used to increase native sensitivity or to extend blue sensitivity. The dyes which extend spectral sensitivity also frequently reduce sensitivity in the region of native sensitivity and thus are both spectral sensitizers and blue desensitizers.

Photographically useful adsorbed dyes can be chosen from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include, joined by a methine linkage, a basic heterocyclic nucleus of the cyanine dye type and an acidic nucleus, such as a malononitrile, alkylsulfonylacetonitrile, cyanomethyl benzofuranyl ketone, cyanomethyl phenyl ketone, 2-pyrazolin-5-one, pyrazolidene-3,5-dione, imidazoline-5-one, hydantoin, 2 or 4-thiohydantoin, 2-iminooxazoline-4-one, 2-oxazoline-5-one, 2-thiooxazolidine-2,4-dione, isoxazoline-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-1,1-dioxide, indoline-2-one, indoline-3-one, indazoline-3-one, 2-oxoindazolinium, 3-oxoindazolinium, 5,7-dioxo-6,7-dihydro-thiazolo[3,2-a]pyrimidine, cycylohexane-1,3-dione, 3,4-dihydroisoquinoline-4-one, 1,3-dioxane-4,6-dione, barbituric acid, 2-thiobarbituric acid, chroman-2,4-dione, indazoline-2-one, or pyrido[1,2-a]pyrimidine-1,3-dione nucleus.

One or more spectral sensitizing dyes can be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, *Photographic Science and Engineering,* Vol. 18, 1974, pp. 418–430.

Spectral sensitizing dyes are also known to affect the emulsions in other ways. For example, spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Dyes which desensitize negative working silver halide emulsions are generally useful as electron accepting spectral sensitizers for fogged direct positive emulsions. Typical heterocyclic nuclei featured in cyanine and merocyanine dyes well suited for use as desensitizers are derived from nitrobenzothiazole, 2-aryl-1-alkylindole, pyrrolo[2,3-b]pyridine, imidazo[4,5-b]quinoxaline, carbazole, pyrazole, 5-nitro-3H-indole, 2-arylbenzindole, 2-aryl-1,8-trimethyleneindole, 2-heterocyclylindole, pyrylium, benzopyrylium, thiapyrylium, 2-amino-4-aryl-5-thiazole, 2-pyrrole, 2-(nitroaryl)indole, imidazo[1,2-a]pyridine, imidazo[2,1-b]thiazole, imidazo[2,1-b]-1,3,4-thiadiazole, imidazo[1,2-b]pyridazine, imidazo[4,5-b]quinoxaline, pyrrolo[2,3-b]quinoxaline, pyrrolo[2,3-b]pyrazine, 1,2-diarylindole, 1-cyclohexylpyrrole and nitrobenzoselenazole. Such nuclei can be further enhanced as desensitizers by electron-withdrawing substituents, such as nitro, acetyl, benzoyl, sulfonyl, benzosulfonyl and cyano groups.

Sensitizing action and desensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. J. Cox, *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, N.Y., 1977, Chapter VIII; Venkataraman, *The Chemistry of Synthetic Dyes,* Academic Press, N.Y., 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Useful blue sensitizing dyes are particularly set out in *Research Disclosure* Item 22534, cited above. Examples of useful supersensitizing dye combinations, of non-light absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898. Among desensitizing dyes useful as spectral sensitizers for fogged direct-positive emulsions are those found in Kendall U.S. Pat. No. 2,293,261, Coenen et al U.S. Pat. No. 2,930,694, Brooker et al U.S. Pat. No. 3,431,111, Mee et al U.S. Pat. Nos. 3,492,123, 3,501,312 and 3,598,595, Illingsworth et al U.S. Pat. No. 3,501,310, Lincoln et al U.S. Pat. No. 3,501,311, VanLare U.S. Pat. No. 3,615,608, Carpenter et al U.S. Pat. No. 3,615,639, Riester et al U.S. Pat. No. 3,567,456, Jenkins U.S. Pat. No. 3,574,629, Jones U.S. Pat. No. 3,579,345, Mee U.S. Pat. No. 3,582,343, Fumia et al U.S. Pat. No. 3,592,653 and Chapman U.S. Pat. No. 3,598,596.

Conventional amounts of the adsorbed dye are contemplated. In using spectral sensitizing dyes it is preferred to employ sufficient dye to realize at least 60 percent of the maximum photographic speed attainable by incorporation of the dye, hereinafter referred to as substantially optimum spectral sensitization. The quantity of the dye will vary depending on the dye or dye combination employed and the surface area presented by the silver halide. For example, high aspect ratio tabular grain silver halide emulsions present increased silver halide surface areas and generally require higher levels of dye for substantially optimum sensitization than corresponding nontabular and lower aspect ratio tabular grain silver halide emulsions. It is known in the photograhic art that optimum spectral sensitization is obtained with organic dyes at about 25 to 100 percent or more of monomolecular layer coverage of the total available surface area of surface sensitive silver halide grains, as disclosed, for example, in West et al, "The Adsorption of Sensitizing Dyes in Photographic Emulsions", *Journal of Phys. Chem.,* Vol. 56, p. 1065, 1952, and Spence et al, "Desensitization of Sensitizing Dyes", *Journal of Physical and Colloid Chemistry,* Vol. 56, No. 6, June 1948, pp. 1090–1103. Higher dye concentrations can be employed for internal latent image forming emulsions, as taught by Gilman et al U.S. Pat. No. 3,979,213. Optimum dye concentration levels can be chosen by procedures taught by Mees, *Theory of the Photographic Process,* Macmillan, 1942, pp. 1067–1069.

The same spectral sensitizing dye or combination of spectral senstizing dyes can be employed in each of the silver halide emulsion layers of a color forming layer unit. It is in some instances advantageous to chose the spectral sensitizing dyes in superimposed silver halide emulsion layers intended to record within the same third of the visible spectrum so that the absorption maxima are displaced in wavelength, such as illustrated by Hopwood et al U.K. Pat. No. 1,530,943 and Japanese Patent Publication 100729/79. Speed improvements attributable to reduced shadowing can be realized when the absorption maxima of overlying and underlying emulsion layers intended to record in the same one of the blue, green, or red third of the visible spectrum are relatively displaced. Silver halide emulsion layers underlying those of relatively high dye concentration levels, such as optimally spectrally sensitized high aspect ratio tabular grain or fine grain silver halide emulsion layers, benefit particularly by employing differing spectral sensitizing dyes to reduce shadowing.

Although it has been specifically recognized that dyes adsorbed to silver halide grain surfaces can inhibit the bleaching of silver by ferric complexes of polycarboxylic acids, it is believed that similar inhibition of bleaching can be imparted by other adsorbed addenda. It is therefore believed that the advantages of the disclosed invention extend also to bleaching from photographic elements silver produced by development of silver halide having adsorbed addenda other than dyes.

The photographic elements can be comprised of any conventional photographic support. Typical photographic supports include polymer film, wood fiber—e.g., paper, metallic sheet and foil, glass and ceramic supporting elements provided with one or more subbing layers to enhance the adhesive, antistatic, dimensional, abrasive, hardness, frictional, antihalation, or other properties of the support surfaces. Typical useful supports are further disclosed in *Research Disclosure,* Item 17643, cited above, Paragraph XVII, here incoporated by reference.

In addition to the features described above the photographic elements can, of course, contain other conventional features known in the art, which can be illustrated by reference to *Research Disclosure,* Item 17643, cited above. For example, the silver halide emulsions can be chemically sensitized, as described in Paragraph III; contain brighteners, as described in Paragraph V; contain antifoggants and stabilizers, as described in Paragraph VI; absorbing and scattering materials, as described in Paragraph VIII, the emulsion and other layers can contain vehicles, as described in Paragraph IX; the hydrophilic colloid and other hydrophilic colloid layers can contain hardeners, as described in Paragraph X; the layers can contain coating aids, as described in Paragraph XI; the layers can contain plasticizers and lubricants, as described in Paragraph XII; and the layers, particularly the layers coated farthest from the support, can contain matting agents, as described in Paragraph XVI. This exemplary listing of addenda and features is not intended to restrict or imply the absence of other conventional photographic features compatible with the practice of the invention.

The preferred photographic elements intended to produce viewable dye images need not incorporate dye image providing compounds as initially prepared, since processing techniques for introducing image dye providing compounds after imagewise exposure and during processing are well known in the art. However, to simplify processing it is common practice to incorporate image dye providing compounds in photographic elements prior to processing, and such photographic elements are specifically contemplated in the practice of this invention. The photographic elements can form dye images through the selective destruction, formation, or physical removal of incorporated image dye providing compounds.

The photographic elements can produce dye images through the selective destruction of dyes or dye precursors, such as silver-dye-bleach processes, as illustrated by A. Meyer, *The Journal of Photographic Science,* Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

The photographic elements can produce dye images through the selective formation of dyes, such as by reacting (coupling) a color-developing agent (e.g., a primary aromatic amine) in its oxidized form with a dye-forming coupler. The dye-forming couplers can be incorporated in the photographic elements, as illustrated by Schneider et al, Die Chemie, Vol, 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure,* Vol. 159, July 1977, Item 15930.

In one form the dye-forming couplers are chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550.

The photographic elements can incorporate alkali-soluble ballasted couplers, as illustrated by Froelich et al and Tong, cited above. The photographic elements can be adapted to form non-diffusible image dyes using dye-forming couplers in developers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602.

The dye-forming couplers upon coupling can release photographically useful fragments, such as development inhibitors or accelerators, bleach accelerators either of a conventional nature or those satisfying formula (I), developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can produce dye images through the selective removal of dyes. Negative or positive dye images can be produced by the immobilization or mobilization of incorporated color-providing substances as a function of exposure and development, as illustrated by U.K. Pat. Nos. 1,456,413, 1,479,739, 1,475,265 and 1,471,752, Friedman U.S. Pat. No. 2,543,691, Whitmore U.S. Pat. No. 3,227,552, Bloom et al U.S. Pat. No. 3,443,940, Morse U.S. Pat. No. 3,549,364, Cook U.S. Pat. No. 3,620,730, Danhauser U.S. Pat. No. 3,730,718, Staples U.S. Pat. No. 3,923,510, Oishi et al U.S. Pat. No. 4,052,214 and Fleckenstein et al U.S. Pat. No. 4,076,529.

One or more compounds satisfying formula (I) can be located in the photographic element at any convenient location capable of permitting their diffusion to a silver containing emulsion layer during bleaching. The formula (I) compound is preferably incorporated directly in the silver halide emulsion layer from which silver is to be bleached, but can alternatively be incorporated in any other bleach solution permeable layer of the photographic element, particularly any layer adjacent the emulsion layer from which silver is to be bleached. When one or more compounds satisfying formula (I) are made available during bleaching entirely by incorporation in a photographic element, such as an otherwise conventional color photographic element, incorporation levels in the range of from $2\times10^{-5}$ to $3\times10^{-3}$ mole/m$^2$ are preferred, with levels of from $10^{-4}$ to $10^{-3}$ mole/m$^2$ being optimum for ordinarily encountered silver levels. To the extent that compounds according to formula (I) are supplied during processing, as by the bleach solution, these concentrations can be reduced. Further, for photographic elements having elevated silver levels still higher levels of the compounds of formula (I) may be desirable.

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wave-like radiant energy in either noncoherent (random phase) forms or coherent (in phase) forms, as produced by lasers. Exposures can be monochromatic, orthochromatic, or panchromatic. Imagewise exposures at ambient, elevated or reduced temperatures and pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18 and 23. Where it is desired to produce silver in the photographic element uniformly rather than in an imagewise manner, uniform rather than imagewise exposure can be undertaken or exposure can be dispensed with entirely. For example, an image can be produced by imagewise bleaching rather than by imagewise exposure.

The exposed photographic elements described above, with or without the compound of formula (I) incorporated, can be processed by any conventional technique to produce silver by development of incorporated silver halide having dye adsorbed to its surface. In the preferred practice of the invention silver is generated imagewise while concurrently producing a dye image, and the silver is thereafter removed by bleaching while leaving the dye image. Residual, undeveloped silver halide can be removed in a separate fixing step or concurrently with bleaching. Typically a separate pH lowering solution, referred to as a stop bath, is employed to terminate development prior to bleaching. A stabilizer bath is commonly employed for final washing and hardening of the bleached and fixed photographic element prior to drying. Conventional techniques for processing are illustrated by *Research Disclosure,* Item 17643, cited above, Paragraph XIX.

Preferred processing sequences for color photographic elements, particularly color negative films and color print papers, include the following:

(P-1) Color development→Stop→Bleaching→Washing→Fixing→Washing→Stabilizing→Drying.

(P-2) Color development→Stop→Bleaching→Fixing→Washing→Stabilizing→Drying.

(P-3) Color development→Stop-Fixing→Bleaching→Fixing→Washing→Stabilizing→Drying.

In each of processes (P-1) to (P-3) variations are contemplated. For example, a bath can be employed prior to color development, such as a prehardening bath, or the washing step can be omitted or postponed to follow the stabilizing step. A specifically preferred process for the practice of this invention is the Kodak Flexicolor C-41 process described in *British Journal of Photography Annual,* 1977, pp. 204 and 205.

Where it is desired to reverse the sense of the color image, such as in color slide processing, reversal processing can be undertaken. Typical sequences for reversal color processing are illustrated by the following:

(P-4) Black-and-white development→Stop→Washing→Fogging→Washing→Color development→Stop→Washing→Bleaching→Washing→Fixing→Washing→Stabilizing→Drying.

(P-5) Black-and-white development→Stop→Washing→Fogging→Washing→Color development→Washing→Bleaching→Fixing→Washing→Stabilizing→Drying.

In each of processes (P-4) and (P-5) baths preceding black-and-white development, such as a prehardening bath, can be employed. The washing step can be omitted or relocated in the sequence. The fogging bath can be replaced by uniform light exposure or by the use of a fogging agent in the color development step to render silver halide not developed in the black-and-white step developable.

While each of the processes described above can be varied, the bleaching step is in each instance performed using a ferric complex of a polycarboxylic acid as a bleaching agent. Such complexes, bleaching and bleach-fixing baths in which they are incorporated, and processes for their use are disclosed in U.S. Pat. Nos. 3,615,508, 3,770,437, 3,870,520, 4,242,442, and 4,288,618, cited above, here incorporated by reference. The complexes are formed by two, three, four, or more $-C_nH_{2n}COOH$ moieties linked directly or by diamine, amine, or divalent chalcogen (e.g., oxygen or sulfur) linking groups. In practice acetic acid moieties are most commonly employed; thus n is 1. However, n can range up to 5 or more. Illustrative of commonly employed ferric ion chelating moieties are ethylenediaminetetraacetic acid (EDTA), nitrilotriacetic acid , diethylenetriaminepentaacetic acid, propylenediaminetetraacetic acid, cyclohexanediaminetetraacetic acid, ethyliminodipropionic acid, methyliminodiacetic acid, ethyliminodiacetic acid, n-propyliminodiacetic acid, and n-butyliminodiacetic acid. The ratio of these chelating moieties to ferric ions can vary widely, for example, from 1:1 to 15:1, optimally from 1:1 to 5:1 on a molar basis. The bleaching agent can be present in concentrations of from about 0.05 to 2 moles, preferably from 0.1 to 0.5 mole, per liter of bleaching solution.

When the compound of formula (I) is initially incorporated entirely in the bleaching solution as opposed to be wholly or partially initially incorporated in the photographic element to be bleached, it is preferably present in a concentration of from about $10^{-3}$ to 1, most preferably from $2\times10^{-3}$ to $5\times10^{-2}$, mole per liter of solution.

Water is employed as a solvent for the bleaching solution. The pH of the bleaching solution is maintained on the acid side of neutrality within conventional ranges, typically in the range of from about 4 to 7, most preferably from about 5 to 6.5. Conventional buffers can be included for pH maintenance, such as boric acid, borax, sodium metaborate, acetic acid, sodium acetate, sodium, potassium carbonate, phosphoric acid, phosphorous acid, or sodium phosphate.

An antifoggant can be incorporated in the bleaching solution, if desired. Antifoggants such as alkali metal (e.g. lithium, sodium, or potassium) bromide or chloride salts are specifically preferred. Other illustrative antifoggants include nitrogen-containing heterocyclic compounds, such as benzotriazole, 6-nitrobenzimidazole, 5-nitroisoindazole, 5-methylbenzotriazole, 5-nitrobenzotriazole, and 5-chlorobenzotriazole, mercapto substituted heterocyclic compounds, such as 1-phenyl-5-mercaptotetrazole, 2-mercaptotetrazole, 2-mercaptobenzimidazole, and 2-mercaptobenzothiazole, and mercapto substituted aromatic compounds, such as thiosalicylic acid. Conventional concentrations can be employed, such as from about 0.1 to 7 moles per liter, preferably from about 0.2 to 2 moles per liter.

To impart also fixing properties to the bleaching solution, thereby converting it to a bleach-fix or blix solution, it is merely necessary to add a silver halide solvent. Alkali metal or ammonium thiosulfates and thiocyanates as well as thioethers are illustrative of useful silver halide solvents. Where a separate fixing bath is employed, it can take any convenient conventional form.

Although the invention has been described in terms of employing one or more compounds according to formula (I) to enhance bleaching, it is appreciated that other, compatible compounds for enhancing bleaching can, if desired, be employed in combination. Further, bleaching can be enhanced by the presence of compounds which also perform other functions. For example, certain brighteners, such as bis[di and tri(hydroxyalkyl)aminotriazinylimino]stilbenes, such as described in Dutch Pat. No. 74109, have been observed to enhance bleaching by more than additive amounts when employed in combination with the compounds of formula (I). To the extent that other compounds employed in combination are relied upon to enhance bleaching the compounds of formula (I) employed can, of course, be reduced in concentration while still achieving effective enhancement of bleaching.

The compounds of formula (I) can be prepared by procedures generally known in the art. The following provide illustrations of preferred compound syntheses:

Preparation of
1,4-Phenylenedimethylbis(2,2'-iminodiethanol) (A-I)

α'α'-Dichloro-p-xylene (175.1 g, 1.0 mole) was added with stirring to a refluxing solution of diethanolamine (231 g, 2.2 mole) and ethanol (300 ml). After refluxing for one hour, the mixture was filtered while hot through a coarse sintered glass funnel. The filtrate was allowed to cool at room temperature. The resulting crystalline white solid was collected by filtration, washed three times with acetone and once with hot ethanol; yield di.HCl salt 380 g (98.5%), MP 138°-140° C. Calc. C, 49.9, H, 7.8., N, 7.3. Found: C, 48.9; H, 7.7; N, 7.2.

The salt was neutralized by treating with an aqueous solution of sodium hydroxide (50% by weight) saturating the mixture with NaCl and extracting with n-butyl alcohol. Flash evaporation of the butyl alcohol yielded an oily gum which gave a white solid upon recrystallization from acetonitrile, M.P. 74°-75° C.

Preparation of
1,4'-Biphenylenedimethylbis(2,2'-iminodiethanol) (M-I)

In a 500 ml 3-necked round bottom flask was placed 25 gm (0.1 mol) of 4,4'-di(chloromethyl)biphenyl in 150 ml ethanol and 23.1 gm (0.22 mol) diethanolamine. The mixture was refluxed with stirring for 6 hours and filtered while hot; the filtrate was allowed to stand in the refrigerator overnight. The small amount of solid which crystallized out was collected and discarded. The solvent was then removed under reduced pressure to give a viscous oil. The product was purified by successive triturations with hot acetone; Yield 40 gm (87%).

Preparation of
4,4'-Bis[N,N-di(2-hydroxyethyl)-aminomethyl]diphenyl ether dihydrochloride (T-I)

In a 300 ml 3-necked round bottom flask was placed 13.4 gm (0.05 mol) of 4,4'-di(chloromethyl)diphenyl ether dissolved in 100 ml acetone. To the solution was added with stirring 11.6 gm (0.11 mol) diethanolamine. The mixture was heated with stirring allowing all the acetone to distill off. After 2 hours of heating on a steam bath, 150 ml of ethanol was added to dissolve the viscous mixture which was then filtered, and cooled to room temperature. While cooling the product separated out as a gum. The solvent was decanted, and the product was purified by trituration with ethanol and acetone; Yield 22.5 gm (95%).

EXAMPLES

The invention can be better appreciated by reference to the following specific examples. Except as noted all coverages in parenthesis are in g/m$^2$.

EXAMPLES 1 AND 2

A first, control photographic element was prepared having the following structure:

| | |
|---|---|
| Layer 4 | Gelatin (0.86), Bis(vinylsulfonylmethyl) ether hardener (0.12) |
| Layer 3 | Gelatin (2.42), Cyan dye forming coupler (1.57) |
| Layer 2 | Gelatin (0.65) |
| Layer 1 | High aspect ratio tabular grain silver bromoiodide emulsion (12 mole percent iodide, ~15:1 average aspect ratio) which was sensitized with substantially optimum amounts of sulfur and gold chemical sensitizers and a green spectral sensitizing dye, silver coverage (3.23), gelatin coverage (3.23), and Yellow dye forming coupler (0.65) |
| | Transparent Film Support |

The cyan dye forming coupler was 1-hydroxy-2-[4-(2,4-di-tert-pentylphenoxy)butyl]-4-[4-(hydroxyethylamino sulfonyl)phenoxy]naphthamide. The yellow dye forming coupler was α-[4-(4-benzyloxyphenylsulfonyl)-phenoxy]-α-pivalyl-2-chloro-5-hexadecylsulfonamidoacetanilide.

First and second example photographic elements were prepared, which were identical to the control described above, except that bleach accelerators A-I and M-1, respectively, were present in Layer 2 in a concentration of $2.5\times10^{-6}$ mole per dm$^2$.

The photographic elements were each exposed through a graduated density test object for one fifth second at 2850° K. using a Daylight V Filter. The photographic elements were then processed using the Kodak C-41 ® process, which is described in the *British Journal of Photography* 1982 *Annual*, pp. 209–211. The infrared density of the photographic elements was read in areas which received maximum exposure after varied bleach times set forth below in Table II. In other words, residual dye density was read in areas having maximum silver density prior to bleaching.

TABLE II

| Element | Bleach Accelerator | Silver Density After Time Indicated in Minutes 0 | 0.5 | 1 | 2 | 3 | 4 |
|---|---|---|---|---|---|---|---|
| Control | None | 1.33 | 0.57 | 0.31 | 0.21 | 0.15 | 0.09 |
| Example 1 | A-I | 1.32 | 0.35 | 0.17 | 0.10 | 0.06 | 0.04 |
| Example 2 | M-I | 1.36 | 0.52 | 0.28 | 0.16 | 0.11 | 0.07 |

It can be seen from Table II that both bleach accelerators A-I and M-I reduced silver density as a function of bleaching time.

EXAMPLES 3 THROUGH 5

In further comparisons color negative photographic elements were prepared differing only in that a different compound being investigated for bleach accelerating properties was present in a high aspect ratio tabular grain silver bromoiodide emulsion layer sensitized to the red portion of the spectrum. As a further check one element was prepared differing only in lacking a compound corresponding to any of the compounds being investigated for bleach accelerating properties. Exposure and processing was similar to that described above in Examples 1 and 2. All compounds compared which satisfied the requirements of formula (I), in this instance L-I and M-I, functioned as bleaching accelerators, while compounds O-C, Q-C, and R-C, which differ in structure from the requirements of formula (I), failed to accelerate bleaching of silver. Compound N-C in this instance functioned as a bleach accelerator, but in the example below functioned as a bleach inhibitor.

EXAMPLES 6 THROUGH 10

A first, control photographic element was prepared having the following structure:

| | |
|---|---|
| Layer 2 | Gelatin (1.08), Bis(vinylsulfonylmethyl) ether hardener (1.75 percent of total weight of gelatin in both layers) |
| Layer 1 | High aspect ratio tabular grain silver bromoiodide emulsion (5 mole percent iodide, ~20:1 average aspect ratio, average grain diameter 2.9 μm, average grain thickness 0.20 μm, and tabular grain projected area >50 percent) which was chemically sensitized with optimum amounts of sulfur and gold, silver coverage (2.42), gelatin coverage (3.77), containing as the spectral sensitizing dye anhydro-5-chloro-9-ethyl-5'-phenyl-3'-(3-sulfobutyl)-3-(3-sulfopropyl)oxacarbocyanine hydroxide, sodium salt (1.5 millimoles/Ag mole), and magenta dye forming coupler 1-(2,4,6-trichlorophenyl)-3-[3-{α-(2,4-di-tert-amylphenoxy)acetamido}benzamido]-5-pyrazolone (0.86) |
| | Film support with antihalation backing |

Additional photographic elements were prepared, which were identical to the control described above, except that various compounds identified below in Table III were introduced into Layer I each at the concentration level of $8.6\times10^{-4}$ millimole/m$^2$. Exposure and processing were as described above in Examples 1 and 2, except that a bleaching time of 4 minutes was employed in each instance.

TABLE III

| Element | Bleach Accelerator | Residual Silver Density |
|---|---|---|
| Control | None | 6.2 |
| Example 6 | L-I | 3.4 |
| Control | N-C | 8.2 |
| Example 7 | V-I | 4.5 |
| Example 8 | W-I | 3.0 |
| Example 9 | B-I | 2.0 |
| Control | X-C | 3.5* |
| Control | Y-C | 4.2* |
| Example 10 | T-I | 1.0 |
| Control | U-C | 12.7 |
| Control | J-C | 4.9 |
| Control | K-C | 5.8 |
| Control | H-C | 5.5 |
| Control | Z-C | 5.9 |
| Control | C-C | 5.7 |
| Control | O-C | 6.5 |
| Control | E-C | 5.3 |

*Severe speed loss

From Table III it is apparent that the bleach accelerators satisfying formula (I) reduced silver density to 4.5 or lower. None of the control bleach accelerators reduced silver density to this extent, except X-C and Y-C, which, however, markedly desensitized the photographic elements in which they were incorporated, thereby rendering them unsuitable for use. It is to be noted that the diammonium salts N-C and U-C corresponding to the diamines and protonated diamines satisfying formula (I) actually functioned as bleach inhibitors rather than bleach accelerators.

The invention has been described in detail with particular reference to preferred embodiments thereof, but it will be understood that variations and modifications can be effected within the spirit and scope of the invention.

What is claimed is:

1. In a process of bleaching from a photographic element silver produced by development of silver halide having a dye adsorbed to its surface comprising employing a ferric complex of a polycarboxylic acid as a bleaching agent, the improvement comprising bleaching in the presence of a bleach enhancing amount of a compound of the formula:

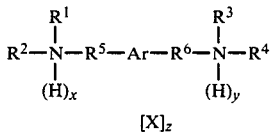

wherein

Ar is an aromatic linking group, $R^1$, $R^2$, $R^3$, and $R^4$ are hydroxy substituted lower alkyl groups, $R^5$ and $R^6$ are lower alkanediyl groups, X is a charge balancing counter ion, x and y are 0 or 1, and z is 0, 1, or 2.

2. In a process according to claim 1, prior to bleaching, the photographic element in an imagewise exposed condition being developed to produce silver imagewise.

3. In a process according to claim 2 a dye image being produced during development to produce silver imagewise.

4. In a process according to claim 3 fixing silver halide from the photographic element following development to produce the dye image.

5. In a process according to claim 2 development to produce silver imagewise occurring in the absence of image dye and a dye image being produced by subsequent development of residual silver halide not initially developed.

6. In a process according to claim 1 the bleach enhancing compound being introduced into.the photographic element concurrently with the bleaching agent.

7. In a process according to claim 6 the bleach enhancing compound being initially present in a solution containing the bleaching agent in a concentration of from $10^{-3}$ to 1 mole per liter.

8. In a process according to claim 1 the bleach enhancing compound being introduced into the photographic element prior to the bleaching agent.

9. In a process according to claim 8 the bleach enhacing compound being incorporated in the photographic element in a concentration of from $2\times10^{-5}$ to $3\times10^{-3}$ mole per square meter.

10. In a process according to claim 1 the hydroxy substituted lower alkyl groups being represented by the formula $-C_nH_{2n}OH$ and the alkanediyl groups being represented by the formula $-C_nH_{2n}-$, wherein n is from 1 to 5.

11. In a process according to claim 10 the silver being produced by development of an emulison containing silver halide grains substantially optimally sensitized with an adsorbed spectral sensitizing dye.

12. In a process according to claim 11 the silver halide being comprised of high aspect ratio tabular grains.

13. In a photographic element containing dye adsorbed to the surface of radiation sensitive silver halide, the improvement comprising a bleach enhancing amount of a compound of the formula:

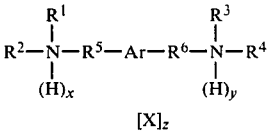

wherein

Ar is an aromatic linking group, $R^1$, $R^2$, $R^3$, and $R^4$ are hydroxy substituted lower alkyl groups, $R^5$ and $R^6$ are lower alkanediyl groups, X is a charge balancing counter ion, x and y are 0 or 1, and z is 0, 1, or 2.

14. In a photographic element according to claim 13 the hydroxy substituted lower alkyl groups being represented by the formula $-C_nH_{2n}OH$ and the alkanediyl groups being represented by the formula $-C_nH_{2n}-$, wherein n is from 1 to 5.

15. In a photographic element according to claim 14 the radiation-sensitive silver halide being present in the form of grains and the adsorbed dye being a spectral sensitizing dye present in an amount sufficient to substantially optimally sensitize said grains.

16. In a photographic element according to claim 15 at least one dye image providing compound being present in the photographic element.

17. In a photographic element according to claim 16 the bleach enhancing compound being present in a concentration of from $10^{-4}$ to $10^{-3}$ mole per square meter.

18. In a photographic element according to claim 15 said radiation-sensitive silver halide forming at least one high aspect ratio tabular grain emulsion layer.

19. In a photographic element according to claim 13 in which said aromatic linking group is comprised of one or two divalent carbocyclic nuclei.

20. In a photographic element capable of forming a multicolor dye image comprised of a support, a blue recording yellow dye image forming layer unit, a green recording magenta dye image forming layer unit, and a red recording cyan dye image forming layer unit, at least one of said layer units including a radiation-sensitive high aspect ratio tabular grain silver halide emulsion layer substantially optimally spectrally sensitized with an adsorbed spectral sensitizing dye, the improvement comprising a bleach enhancing amount of a compound of the formula:

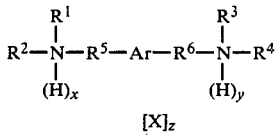

wherein

Ar is a carbocyclic aromatic linking group, $R^1$, $R^2$, $R^3$, and $R^4$ are hydroxy substituted lower alkyl groups of from 1 to 3 carbon atoms, $R^5$ and $R^6$ are lower alkanediyl groups of from 1 to 3 carbon atoms, X is a charge balancing counter ion, x and y are 0 or 1, and z is 0, 1, or 2.

21. In a multicolor photographic element according to claim 20 said carbocyclic aromatic linking group being comprised of one or two nuclei chosen from the group consisting of phenylene and naphthalene nuclei.

22. In a multicolor photographic element according to claim 21 wherein said hydroxy substituted lower alkyl groups are 2-hydroxyethyl groups and said alkanediyl groups are methylene groups.

23. In a multicolor photographic element according to claim 20 said bleach enhancing compound being chosen from the group consisting of 1,4-arylenedialkylbis(2,2'-iminodialkanol), 1,3-arylenedialkylbis(2,2'-iminodialkanol) dihydrohalide, 1,4-arylenedialkylbis(2,2'-iminodialkanol) dihydrohalide, 1,4'-biarylenedialkylbis(2,2'-iminodialkanol), 1,4-(2,5-dihalo)arylenedialkylbis(2,2'-iminodialkanol), 4,4'-bis[N,N-di(2-hydroxyalkyl)aminoalkyl]diaryl ether dihydrohalide, 1,4-arylenedialkylbis(2,2'-iminoalkanol) dihydrohalide, and 1,3-arylenedialkylbis(2,2'-iminodialkanol).

24. An aqueous bleaching solution containing a ferric complex of a polycarboxylic acid as a bleaching agent and a bleach enhancing amount of a compound of the formula:

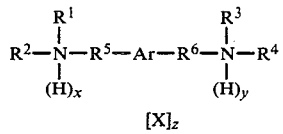

wherein

Ar is an aromatic linking group, $R^1$, $R^2$, $R^3$, and $R^4$ are hydroxy substituted lower alkyl groups, $R^5$ and $R^6$ are lower alkanediyl groups, X is a charge balancing counter ion, x and y are 0 or 1, and z is 0, 1, or 2.

25. A bleaching solution according to claim 24 having a pH in the range of from 4 to 7.

26. A bleaching solution according to claim 24 including an antifoggant.

27. A bleaching solution according to claim 24 including a silver halide solvent.

28. A bleaching solution according to claim 24 in which said bleach enhancing compound is present in a concentration of from $2\times10^{-3}$ to $5\times10^{-2}$ mole per liter.

29. A bleaching solution according to claim 28 in which the hydroxy substituted lower alkyl groups satisfy the formula $-C_nH_{2n}OH$ and the alkanediyl groups satisfy the formula $-C_nH_{2n}-$, wherein n is from 1 to 5.

30. A bleaching solution according to claim 29 in which the arylene linking group is comprised of one or two carbocyclic aromatic nuclei chosen from the group consisting of phenylene and naphthalene linking groups.

31. An aqueous bleaching solution having a pH in the range of from 5 to 6.5 containing a ferric complex of a polycarboxylic acid as a bleaching agent, an alkali metal halide antifoggant, and from $2\times10^{-3}$ to $5\times10^{-2}$ mole per liter of a bleach enhancing compound of the formula:

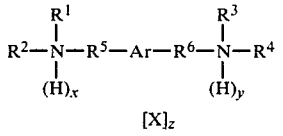

wherein

Ar is a carbocyclic aromatic linking group, $R^1$, $R^2$, $R^3$, and $R^4$ are hydroxy substituted lower alkyl groups of from 1 to 3 carbon atoms, $R^5$ and $R^6$ are lower alkanediyl groups of from 1 to 3 carbon atoms, X is a charge balancing counter ion, x and y are 0 or 1, and z is 0, 1, or 2.

32. An aqueous bleaching solution according to claim 31 wherein said bleach enhancing compound is chosen from the group consisting of 1,4-phenylenedimethylbis(2,2'-iminodiethanol), 1,3-phenylenedimethylbis(2,2'-iminodiethanol) dihydrochloride, 1,4-phenylenedimethylbis(2,2'-iminodiethanol) dihydrochloride, 1,4'-biphenylenedimethylbis(2,2'-iminodiethanol), 1,4-(2,5-dichloro)phenlyenedialkylbis(2,2'-iminodiethanol), 4,4'-bis[N,N-di(2-hydroxyethyl)aminomethyl]diphenyl ether dihydrochloride, 1,4-phenylenedimethylbis(2,2'-iminodiethanol) dihydrochloride, and 1,3-phenylenedimethylbis(2,2'-iminodiethanol).

* * * * *